US008586889B2

(12) United States Patent
Barthelmes et al.

(10) Patent No.: US 8,586,889 B2
(45) Date of Patent: Nov. 19, 2013

(54) MULTIPOSITION SWITCH

(75) Inventors: Owen R. Barthelmes, Putnam Valley, NY (US); Michael A. Hoyack, Sandy Hook, CT (US); Joachim I. Grek, Katrineholm (SE)

(73) Assignee: Amphenol Corporation, Wallingfordm, CT (US)

( * ) Notice: Subject to any disclaimer, the term of this patent is extended or adjusted under 35 U.S.C. 154(b) by 251 days.

(21) Appl. No.: 13/085,045

(22) Filed: Apr. 12, 2011

(65) Prior Publication Data

US 2012/0261238 A1 Oct. 18, 2012

(51) Int. Cl.
*H01H 9/00* (2006.01)

(52) U.S. Cl.
USPC ..... 200/570; 200/571; 200/11 DA; 200/4

(58) Field of Classification Search
USPC ..... 200/4, 11 D, 570, 571
See application file for complete search history.

(56) References Cited

U.S. PATENT DOCUMENTS

| | | | | |
|---|---|---|---|---|
| 1,215,807 | A | 2/1917 | Huff | |
| 2,208,500 | A | 7/1940 | Gates | |
| 2,853,565 | A | 9/1958 | Arthur et al. | |
| 2,855,795 | A * | 10/1958 | Beal | 74/483 K |
| 3,109,901 | A | 11/1963 | Irving | |
| 3,181,086 | A | 4/1965 | McCutcheon et al. | |
| 3,258,548 | A | 6/1966 | Cartier et al. | |
| 3,345,488 | A | 10/1967 | Siegal | |
| 3,363,070 | A | 1/1968 | Kussy | |
| 3,969,690 | A | 7/1976 | Hansen et al. | |
| 4,166,236 | A | 8/1979 | Andrews | |
| 4,366,452 | A | 12/1982 | Dittman et al. | |
| 4,497,984 | A | 2/1985 | Ashman et al. | |
| 4,650,943 | A | 3/1987 | Boinski | |
| 4,831,222 | A | 5/1989 | Grellmann et al. | |
| 4,920,324 | A | 4/1990 | Whittaker et al. | |
| 5,010,214 | A * | 4/1991 | Yamazaki | 200/6 B |
| 5,426,274 | A | 6/1995 | Bruggemann et al. | |
| 5,451,918 | A | 9/1995 | Sun | |
| 5,735,391 | A | 4/1998 | Harrell et al. | |
| 5,748,055 | A * | 5/1998 | Ors | 333/106 |
| 5,969,309 | A | 10/1999 | Nishimura et al. | |
| 6,246,298 | B1 | 6/2001 | Ishikawa et al. | |
| 6,448,869 | B1 | 9/2002 | Kich et al. | |
| 6,737,598 | B1 | 5/2004 | Allen et al. | |
| 6,809,281 | B2 * | 10/2004 | Miki | 200/529 |
| 6,816,026 | B2 | 11/2004 | Dybdal | |
| 6,856,212 | B2 * | 2/2005 | Kwiatkowski et al. | 333/105 |
| 7,528,335 | B2 | 5/2009 | Lanser et al. | |

* cited by examiner

*Primary Examiner* — Edwin A. Leon
*Assistant Examiner* — Ahmed Saeed
(74) *Attorney, Agent, or Firm* — Blank Rome LLP

(57) ABSTRACT

A multiposition switch that comprises a base member accommodating a plurality contact members, respectively. The plurality of contact members are adapted to electrically mate to a host printed circuit board. A routing subassembly is rotatably coupled to the base member. The routing subassembly includes a routing member that defines a plurality of electrical paths between the contact members for switching between combined and uncombined positions. An actuator is coupled to the rotating member for rotating the routing member with respect to the base member between the combined and uncombined positions.

23 Claims, 8 Drawing Sheets

MULTIPOSITION SWITCH

FIELD OF THE INVENTION

The present invention relates to a switch capable of multiple positions. More specifically, the switch includes positions for combining RF power and for uncombining RF power that may be selected based on contact radial positioning of contacts of the switch.

BACKGROUND OF THE INVENTION

RF switches are often used to transfer power from one electrical circuit to one of a number of circuits. There are several options for switching used in the industry today. One option is to use multiple solenoid actuated single pole double throw switches or relays. However, at least three of those switches are typically required to fulfill system requirements. Another disadvantage is in the reliability of the solenoid actuation mechanism. The solenoid itself and the associated moving parts have a higher potential for failure than a mechanical switch. Another common technology is an integrated connector switch. These are connectors with internal mechanisms that develop the switching action as a traditional connector is engaged. The physical movement associated with engagement is transferred to a switching action internal to the device. In typical applications, at least two of these switching connectors are required in each system. Also, because integrated connector switches must be positioned at the I/O port of the equipment, they are more susceptible to damage or contamination from the outside.

SUMMARY OF THE INVENTION

Accordingly, the present invention provides a multiposition switch that comprises a base member accommodating a plurality contact members, respectively. The plurality of contact members are adapted to electrically mate to a host printed circuit board. A routing subassembly is rotatably coupled to the base member. The routing subassembly includes a routing member that defines a plurality of electrical paths between the contact members for switching between combined and uncombined positions. An actuator is coupled to the rotating member for rotating the routing member with respect to the base member between the combined and uncombined positions.

The present invention may also provide a multiposition switch that comprises a base member accommodating a plurality radially spaced contact members, respectively. The plurality of contact members are adapted to electrically mate to a host printed circuit board. A routing subassembly is rotatably coupled to the base member. The routing subassembly includes a routing disc that defines a plurality of electrical paths between the plurality of contact members for switching between combined and uncombined positions. An actuator is coupled to the rotating disc for rotating the routing disc with respect to the base member between the combined and uncombined positions. In the combined position, a first contact member of the plurality of contact members may be electrically coupled to a second contact member of the plurality of contact members via the electrical paths of the routing disc, and a third contact member of the plurality of contact members may be electrically coupled to a fourth contact member of the plurality of contact members via the electrical paths of the routing disc. In the uncombined position, the first contact member may electrical connected to the third contact member via the electrical paths of the routing member, and the second contact member may be electrically connected to the fourth contact member.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 10:
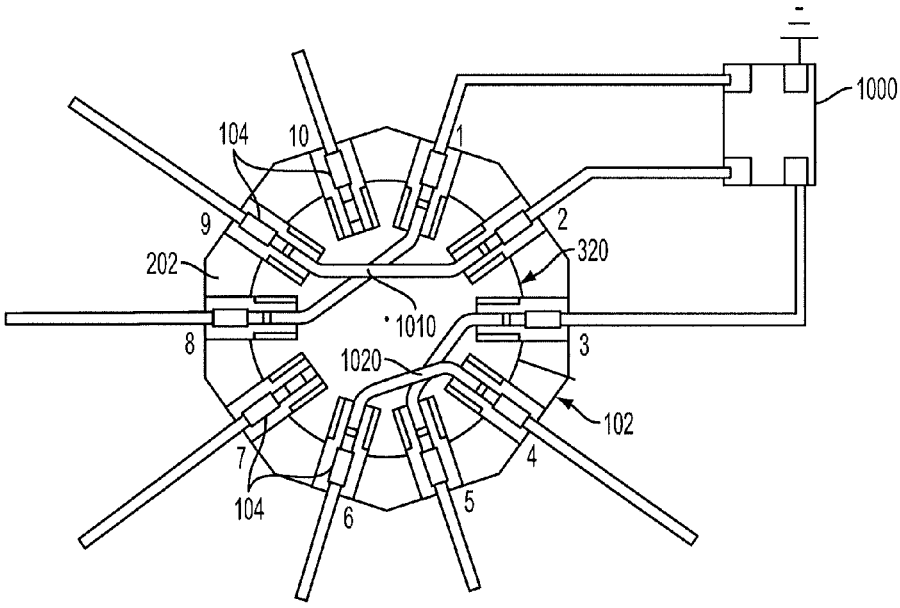
FIG. 10 is a partial top elevational view of the switch according to an exemplary embodiment of the invention, showing the switch and the contacts thereof in a combined position corresponding to the first location of the routing subassembly.
Figure 11:
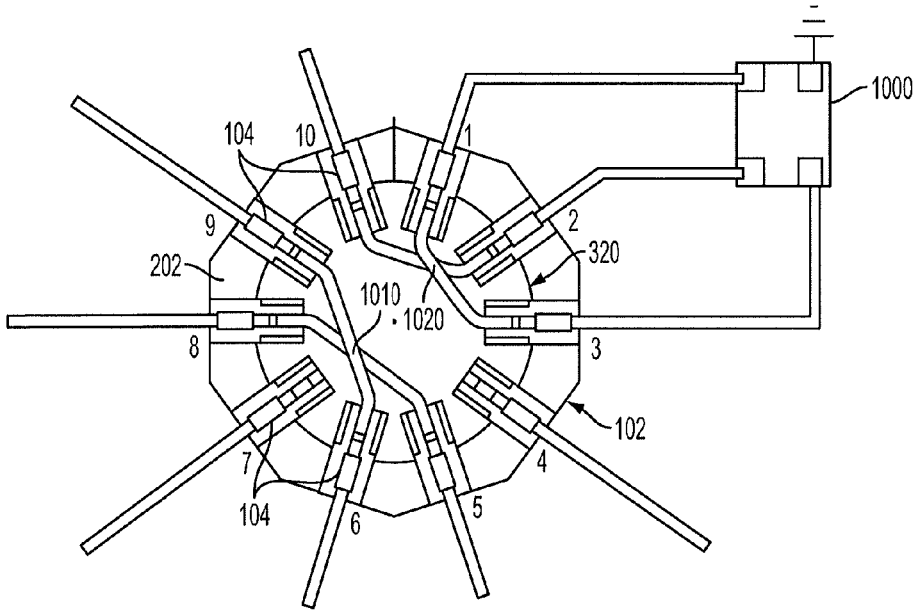
FIG. 11 is a partial top elevational view similar to FIG. 10, except showing the switch and the contacts thereof in the uncombined position corresponding to the second location of the routing subassembly.

Referring to FIGS. 1-5, 6A, 6B, 7A, 7B and 8-11, a multiposition switch 100 according to an exemplary embodiment of the present invention generally includes a base 102 that accepts a plurality of contacts 104 and a routing subassembly 106 that may be used to route signals to different output contacts of the base 102 depending on the radial positioning of the contacts 104. For example, the routing subassembly 106 may be used to combine signals from more than one power amplifier in the combined position (FIG. 10) or separate those signals in the uncombined position (FIG. 11). The present invention provides the advantage of a single switch that serves two functions. One is to route at least two input signals onto a path of a routing member of the routing subassembly 106 with combining circuitry. The other is to route the signals to a path that continues through to separate outputs in the system. Also, the switch provides for many possibilities to process in different ways depending on the printed circuit board circuitry of the routing member. The switch provides for at least two different routing options while maintaining signal integrity specifically with respect to loss and isolation (or crosstalk). Within the system itself, the function of combined or un-combined modes allows for the base station to be set up with antenna diversity. In the combined mode, only one antenna is used. In the un-combined mode, with two final outputs, two antennas can be used. Two antennas provide diversity and therefore improved quality of the receive signal.

Figure 2:
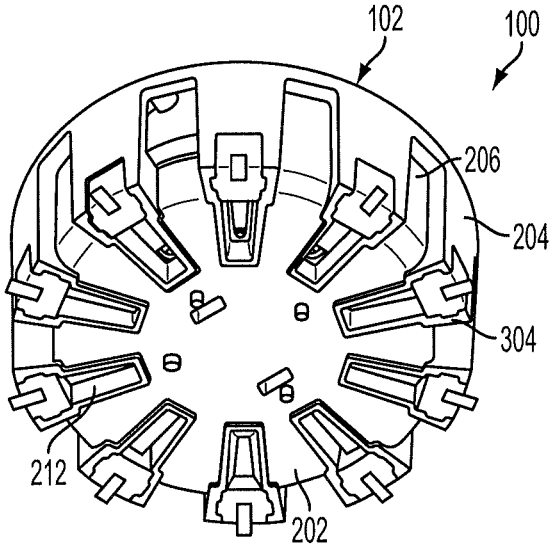
FIG. 2 is a bottom perspective view of the switch illustrated in FIG. 1.
Figure 3:
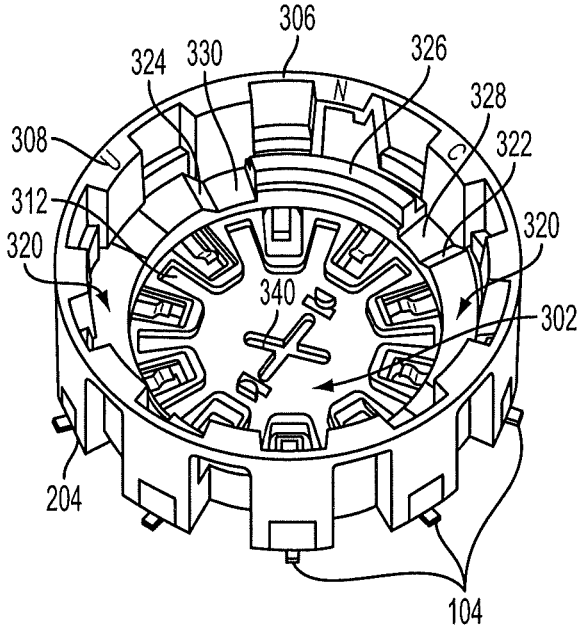
FIG. 3 is a top perspective view of a base of the switch illustrated in FIG. 1.
Figure 5:
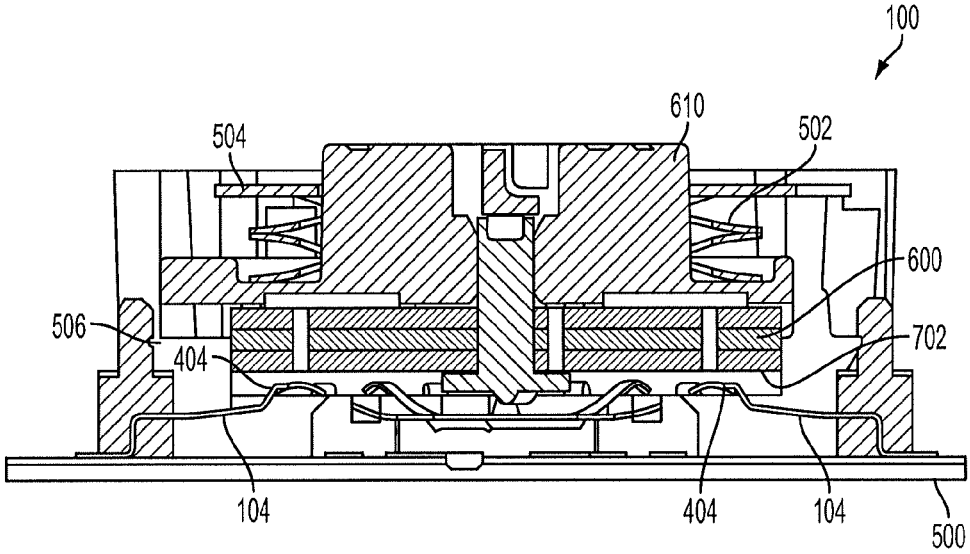
FIG. 5 is a cross-sectional view of the switch illustrated in FIG. 1, showing the switch mounted to a host circuit board.

The base 102 is generally formed of a bottom wall 202 and a substantially cylindrical side wall 204, as seen in FIG. 2. The bottom wall 202 and the side wall 204 create a receiving area 302, as seen in FIG. 3, for holding the routing subassembly 106. A top portion 306 of the side wall 204 may include indicia 308 to facilitate positioning of the switch. For example, the indicia 308 may include letters, such as the letter "C" corresponding to a first location of the switch and the letter "U" corresponding to a second location of the switch. The base 102 may be either formed as one-piece or the bottom wall 202 and the side wall 204 of the base 102 may be formed separately and attached to one another. The bottom wall 202 may include alignment posts 210 (FIG. 2) for engaging a host printed circuit board 500 (FIG. 5). The base 102 is preferably formed of a metal material.

Figure 4:
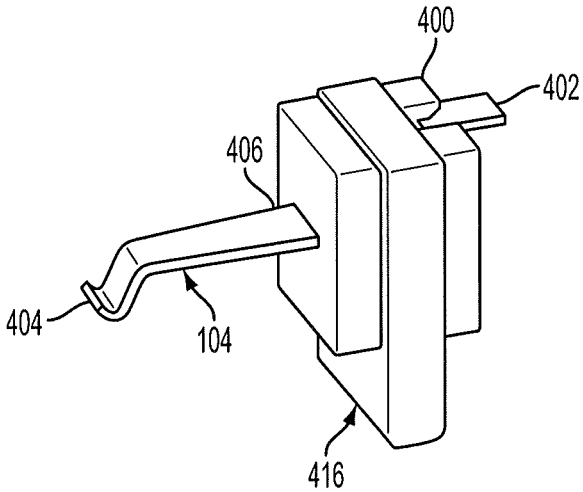
FIG. 4 is a perspective view of a contact and insulator of the switch illustrated in FIG. 1.

A plurality of radial slots 212 may be provided in the bottom wall 202 of the base 102 that are designed to accept individual insulators 400, as seen in FIGS. 2-4. The base side wall 204 may include a plurality of windows 206 arranged between the radial slots 304. Each insulator 400 supports an individual contact 104, as seen in FIG. 4. The insulators 400 are preferably formed of a dielectric material, such as any plastic and may be overmolded onto the individual contacts 104.

As best seen in FIG. 2, the plurality of contacts 104 are radially spaced about the base bottom wall 202. Each contact 104 includes a first end portion 402 that mounts to the host circuit board 500, a second end portion 404 opposite the first end portion 402 that contacts the routing assembly 106, and an intermediate portion 406 therebetween. As best seen in FIG. 4, the insulator 400 covers the intermediate portion 406 such that the end portions 402 and 404 of the contacts 104 extend freely from opposite sides of the insulator 400. The subassemblies of the insulators 400 and contacts 104 may be assembled from outside the bottom wall 202 of the base 102 and into the slots 304 for setting the contacts 104 coplanar to the base bottom surface. A barb 506 (FIG. 5) may be provided in the base 102 for retaining a tower 416 protruding from the insulator 400, which allows the contact end 402 to be set coplanar to the base bottom surface. The insulator tower 416 provides alignment and support for contact 104 within base 102. A clearance fit between the insulator tower 416 and the respective slot 304 at the base bottom surface provides a loose alignment of insulator 400 to the base 102. That allows for a loose placement of the insulators 400 in the base 102 before pressing the insulators 400 into the base 102, thereby eliminating the need for assembly tools for aligning the insulators 400 with the base 102.

Figure 6A:
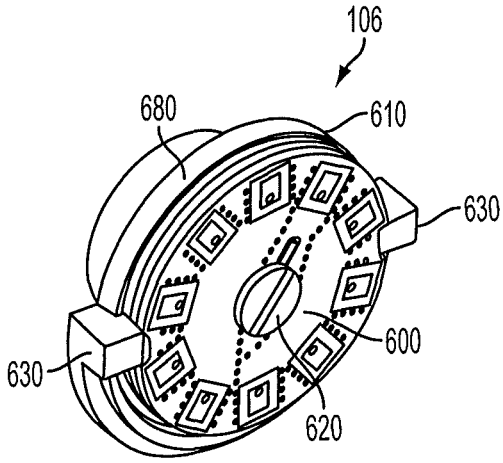
FIG. 6A is a bottom perspective view of a routing subassembly of the switch illustrated in FIG. 1.
Figure 6B:
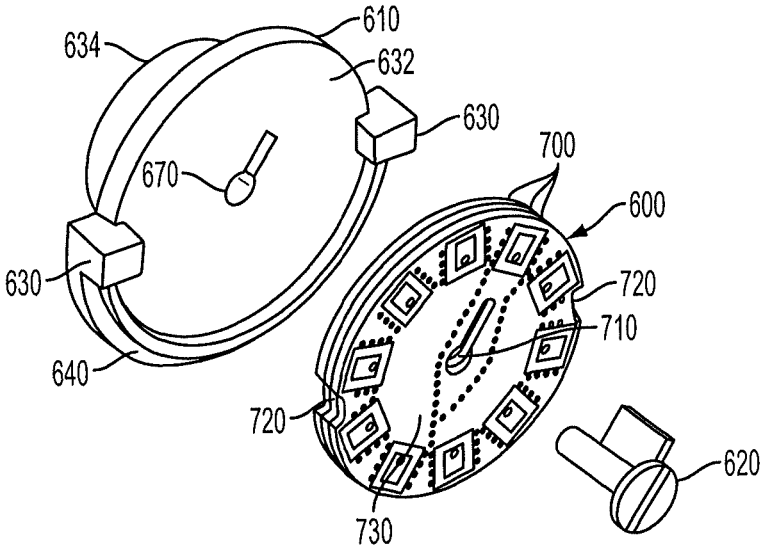
FIG. 6B is an exploded perspective view of the routing subassembly illustrated in FIG. 6A.

The routing subassembly 106 of the switch 100 generally includes a routing member 600 that is held in an actuator 610, as best seen in FIGS. 6A and 6B. The routing member 600 and the actuator 610 are assembled as the routing subassembly 106 via a fastener 620 and then inserted into the receiving area 302 of the switch base 102. A grounding spring (not shown) may be sandwiched between the routing member 600 of the routing subassembly 106 and the inner surface 312 of the bottom wall 202 of the base 102. The grounding spring may have a plurality of outwardly extending spring arms with ends that contact the routing member 600.

Figure 7A:
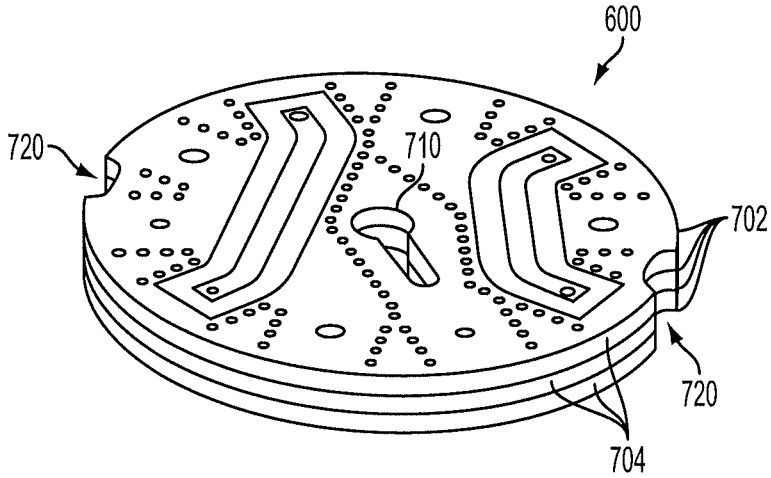
FIGS. 7A and 7B are top and bottom perspective views, respectively, of a routing member of the routing subassembly illustrated in FIGS. 6A and 6B.
Figure 7B:
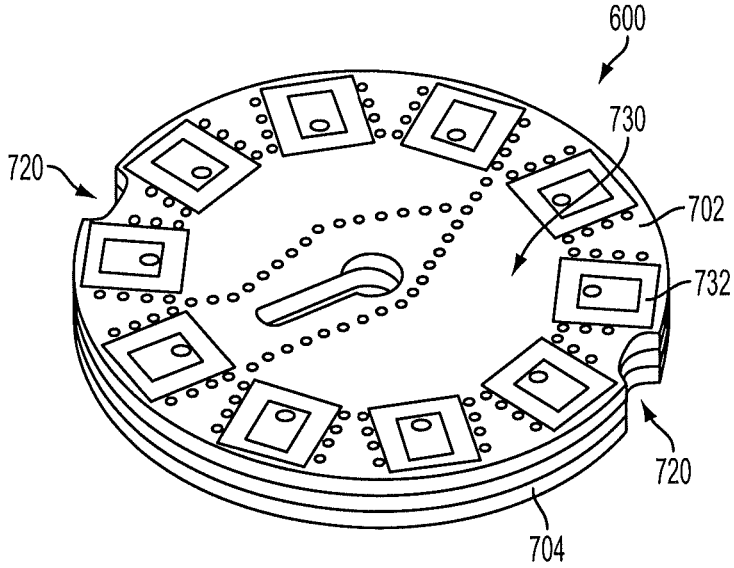

The routing member 600 may be a disc formed of multiple disc-shaped printed circuit boards 700 stacked together. Each board 700 may have electronic circuitry designed for switching electrical paths between the contacts 104. As seen in FIGS. 7A and 7B, the routing disc 600 may include for example, four copper layers 702 with three dielectric layers 704 therebetween to form the stack of printed circuit boards 700. The copper layers 702 and their circuitry may be electrically connected by via holes or the like. A key hole 710 in the disc 600 corresponds to the fastener 620, as seen in FIG. 6B. First and second opposite peripheral notches 720 are provided in the routing disc 600 for accepting peripheral tabs 630 of the actuator 610. The location of the key hole 710 of disc 600 and a key hole 670 of the actuator 610 (which receive the fastener 620) in conjunction with the location of the peripheral notches 720 and the peripheral tabs 630 ensures that the routing disc 600 can only be assembled to the actuator 610 in one position, thus eliminating the possibility for incorrect positioning of the routing disc 600 when assembling the switch.

Figure 1:
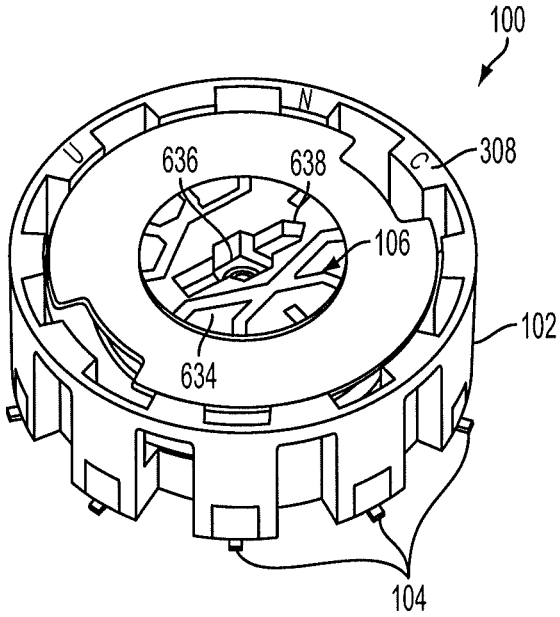
FIG. 1 is a top perspective view of the multiposition switch according to an exemplary embodiment of the present invention.

The actuator 610 has a main body 632 shaped to accommodate the routing disc 600 on one side thereof and supports an actuating knob 634 on the other side. The knob preferably includes slot 636 (FIG. 8) configured to receive an actuating tool. The slot 636 may include an arrow head shaped end 638 (FIG. 8) to indicate the position of the switch, as seen in FIG. 1. For example, the switch may be in the first location when the arrow head shaped end 638 is pointing to the indicia 308 letter "C" marked on the base 102, as seen in FIG. 1, and may be in the second location when the arrow head shaped end 638 is pointing to the letter "U" marked on the base 102.

Figure 8:
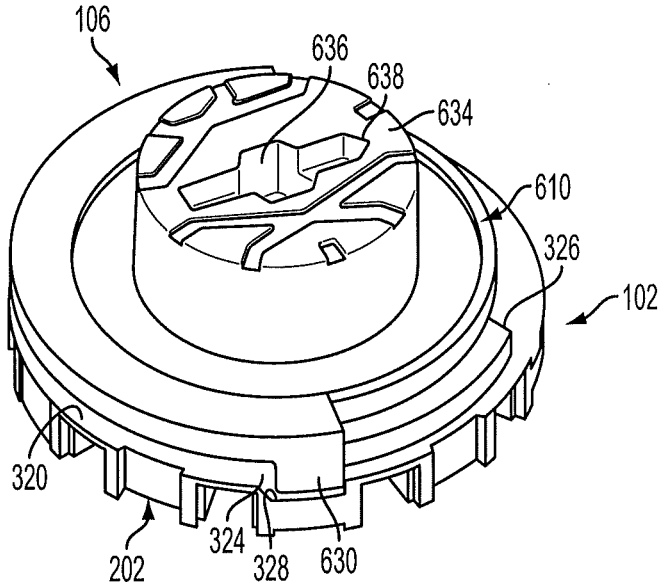
FIG. 8 is a perspective view of the routing subassembly and a partial perspective view of the base of the switch illustrated in FIG. 1, showing the routing subassembly in a first location with respect to the base.
Figure 9:
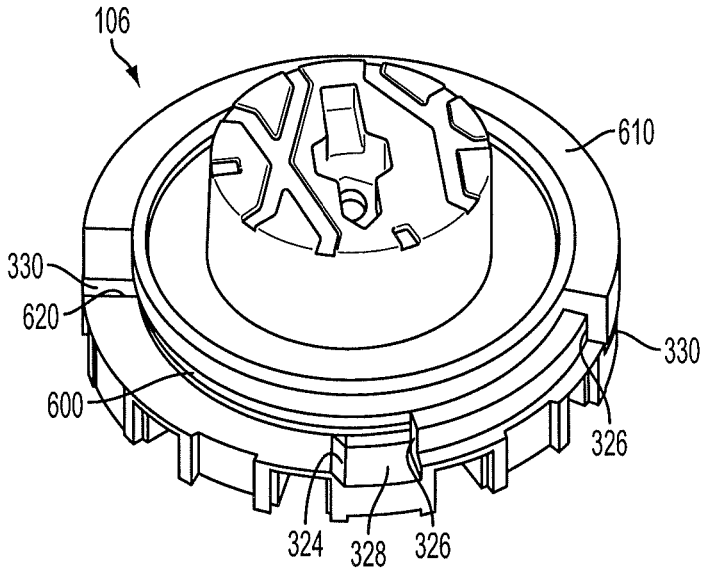
FIG. 9 is a perspective view similar to FIG. 8, showing the routing subassembly in a second location with respect to the base.

A peripheral flange 640 extends from one of the peripheral tabs 630 to the other of the peripheral tabs 630. The peripheral flange 640 interferes with abutment wall 327 when routing assembly 106 is fully seated in base 102. A side 680 of the actuator 106 has clearance with abutment wall 326 when the routing assembly 106 is fully seated in the base 102. Therefore, the peripheral flange 640 and abutment wall 326 provide positional keying of routing assembly 106 to the base 102 during the assembling of routing assembly 106 into base 102 and prevent routing assembly 106 from being assembled incorrectly into the base 102. The peripheral tabs 630 of the actuator 610 are adapted to engage the base 102 for proper positioning of the switch in the combined and uncombined positions, as seen in FIGS. 8-9. In the combined and uncombined positions, the bottom metal surface 730 (FIG. 7B) of the routing disc 600 rests against the bottom inner surface 312 of the base 102. That direct contact between the routing disc 600 and the base 102 provides a direct heat sink for any heat generated in routing disc 600, particularly when routing high power signals. The direct contact between the routing disc 600 and the base 102 also aids in the isolation of RF signals a the point where the ends 404 of the contacts 104 electrically and mechanically contact the bottom layer 702 of the routing disc 600. The actuator 610 rests on the top surface of the routing disc 600. Thus, the distance between the peripheral tabs 630 and the recesses 330 is dependent upon the dimensional variation of the routing disc 600 and requires clearance to ensure that the bottom surface 730 of the routing disc 600 always makes direct contact with the inner surface 312 of the base 102. The fastener 620 may have a rib 622 that aligns with grooves 340 (FIG. 3) of the base 102. The grooves 340 in the base 102 may locate the switch in the combined and uncombined positions. The fastener 620 rests on the bottom surface 312 of routing disc 600. Thus the clearance is not dependent upon the dimensional variation of routing disc 300 and may be smaller than the clearance gap between peripheral tabs 630 and the recesses 330. The smaller clearance between rib 622 and grooves 340 reduces the radial movement of routing assembly 106 with respect to base 102 in the combined and uncombined positions. The fastener 620 facilitates positioning of the routing assembly 106. The positioning of routing assembly 106 with respect to base 102 results in fine positioning between the ends 404 of contacts 104 with respect to contact pads 732 of the routing disc 600, thus reducing variation in RF performance. Each tab 630 engages a raised rib 320 (FIG. 3) extending from the inner surface 312 of the base bottom wall 202 to facilitate rotational movement of the routing subassembly 106 between the combined and uncombined positions. Each raised rib 320 of the base 102 may include entrance and exit ramps 322 and 324 that engage the tabs 630 of the actuator 610 to lift and lower the routing disc 600 as it moves between positions. An abutment wall 326 is provided between the raised ribs 320 that stops the tabs 630 of the actuator 610 to control and limit the rotational movement of the routing disc 600.

The switch 100 may also include a spring member 502 and a cover plate 504, as seen in FIG. 5, to secure the routing assembly 106 in the base 102. The spring member 502 may be a compression spring ring, for example, that is sandwiched between the cover plate 504 and the actuator 610 to bias the routing disc 600 into contact with the plurality of contacts 104 of the base 102. The cover plate 504 may be generally ring shaped with outer catches that catch inside of the base 102 to secure the routing subassembly 106 therein.

FIGS. 8 and 9 illustrate the rotational movement of the routing subassembly 106 between multiple positions. In particular, FIG. 8 shows the routing subassembly 106 in a first location with respect to the base bottom wall 202 (the base 102 being shown without its sidewall 102 for clarity). The first location may be the combined position where the circuitry of the routing member 600 of the routing subassembly 106 is in contact with the ends 404 of certain contacts of the radially spaced contacts 104, as illustrated in FIG. 10. That is, the ends 404 of the contacts 104 electrically and mechanically contact the bottom layer 702 of the routing disc 600, as seen in FIG. 5 (showing the switch in a neutral position). At this first location, the tabs 630 rest in recesses 328 (FIG. 3) which are adjacent the entrance ramps 324 of the raised ribs 320 of the base 102 (FIG. 8 shows one recess 328 and one entrance ramp 324). The routing subassembly 106 can then be rotated with respect to the base 102 to a second location by turning the actuating knob 634 of the actuator 610 (e.g. the actuating knob is turned clockwise in FIG. 8). As the routing subassembly 106 is being rotated to the second position, the routing subassembly 106 is lifted to an intermediate location onto the raised ribs 320 of the base 120 by the engagement of tabs 630 of the actuator 610 with the entrance ramps 610 of the base bottom wall 202. At this intermediate location, the routing member 600 is spaced from and does not contact the contacts 104.

The routing member 600 then rotates to the second location, as seen in FIG. 9, in which the tabs 630 thereof rest in recesses 330 adjacent the exit ramps 620. Because the routing member 600 is no longer resting on the raised ribs 320 of the base 102, the routing member 600 of the routing subassembly 610 connects with the contacts 104 in the second location. The second location may be the uncombined position in which the circuitry of the routing member 600 is in contact with the ends 404 of certain contacts of the contacts 104, as illustrated in FIG. 11. That is, the ends 404 of the certain contacts 104 electrically and mechanically contact the bottom layer 702 of the routing disc 600, as seen in FIG. 5. From the first location to the second location, the routing member rotates about 108°, for example, with respect to the bottom wall 202 of the base 102. Once in the second location, the abutment wall 326 prevents the routing subassembly 106 from rotating past the second location by stopping the tabs 630. However, when at the second location, the routing subassembly 106 may be rotated back to the first location in the same manner discussed above in the opposite direction with respect to the base 102 (counterclockwise in FIGS. 8 and 9).

FIG. 10 is a top view of the switch 100 according to the present invention showing the electrical paths of the contacts 104 through the routing member 600 in the combined position (the routing member 600 is shown as being transparent for clarity). As seen in FIG. 10, the base 102 includes ports 1 thru 10 for respective contacts 104 radially spaced around the base bottom wall 202. Although, ten ports are preferred, more or less ports and contacts than ten may be used with the switch 100. In the combined position, the circuitry of the routing member 600 electrically connects, for example, the contact 104 at port 8 to the contact 104 at port 1, the contact 104 at port 9 to the contact 104 at port 2, the contact 104 at the port 6 to the contact 104 at the port 4, and the contact 104 at the port 5 to the contact 104 at the port 3. By these connections, power amplifier (PA1) connected to port 8 is combined with power amplifier (PA2) at port 9 by a combiner 1000 which is coupled to ports 1 and 2. The combined power of PA1 and PA2 are also coupled to an active trace such as a filter (Filter 1). The output signal passes through a filter before coupling to an antenna for transmitting and receiving. The filter is usually a passive device with a complex mechanical structure that filters the RF signal as required by the specific band of the base station. The remaining ports may be inactive.

The multilayer routing disc 600 is capable of routing signals over top of each other at 1010 and 1020, as seen in FIG. 10, thereby allowing for flexibility in placement of the input and output signal traces on the host printed circuit board 500. By routing signals over top of each other, the need for crossing signals on the host board 500 is eliminated, thus saving costs in the design and manufacture of the host printed circuit board 500. The construction of the multilayer routing disc 600 allows for good isolation between the signals that are crossing over top of each other.

To uncombined PA1 and PA2, the routing member 600 is rotated to the second location with respect to the base 102, as discussed above. As seen in FIG. 11, in the uncombined position, PA1 and PA2 are no longer combined and are instead directed to filters (Filter 1 and Filter 2), respectively. In the uncombined position, the circuitry of the routing member 600 electrically connects, for example, the contact 104 at port 8 to the contact 104 at port 5, the contact 104 at port 9 to the contact 104 at port 6, the contact 104 at port 3 to the contact 104 at port 1, and the contact 104 at port 2 to the contact 104 at port 10. Additional ports may be provided, such as at port 7, for connection to a DC circuit, for example. As seen in FIG. 11, ports 8 and 9 for PA1 and PA2 are no longer electrically coupled to the combiner 1000.

While particular embodiments have been chosen to illustrate the invention, it will be understood by those skilled in the art that various changes and modifications can be made therein without departing from the scope of the invention as defined in the appended claims. For example, although the tabs 630 which facilitate rotating of the routing subassembly between positions are located on the actuator, those tabs may be located on the routing disc 600 instead.

What is claimed is:

1. A multiposition switch, comprising:

a base member accommodating a plurality contact members said plurality of contact members being adapted to electrically mate to a host printed circuit board; and a routing subassembly rotatably coupled to said base member, said routing subassembly including a routing member that defines a plurality of electrical paths between said contact members for switching between combined and uncombined positions, said routing member being a disc that includes a plurality of stacked printed circuit boards electrically coupled to one another, and an actuator coupled to said routing member for rotating said routing member with respect to said base member between said combined and uncombined positions.

2. A multiposition switch according to claim 1, wherein said plurality of stacked printed circuit boards are electrically coupled by via holes.

3. A multiposition switch according to claim 1, wherein said plurality of contact members are radially spaced about a bottom wall of said base member, and each of said contact members has opposite first and second ends, said first ends are configured to couple to the host printed circuit board and the second ends are configured to couple to the routing member.

4. A multiposition switch according to claim 3, wherein each of said plurality of contact members includes an intermediate portion between said first and second ends; and an insulator surrounds said intermediate portion of each of said contact members.

5. A multiposition switch according to claim 1, wherein at least one of said routing member and said actuator includes at least one tab for engaging said base member, said tab limiting the rotating movement of said routing member with respect to said base member.

6. A multiposition switch according to claim 5, wherein said tab limits the rotational movement of said routing member with respect to said base member between about 108°.

7. A multiposition switch according to claim 6, wherein said base member includes a bottom wall; and said bottom wall of said base member includes at least one raised rib for engaging said tab.

8. A multiposition switch according to claim 7, wherein said raised rib of said bottom wall includes first and second opposite ramps that engage said tab when rotating said routing member with respect to said base member, thereby raising the routing assembly with respect to said base member during rotation.

9. A multiposition switch according to claim 1, further comprising a spring member disposed on said actuator biasing said routing member into contact with said plurality of contacts.

10. A multiposition switch according to claim 1, wherein said base member includes a bottom wall and a cylindrical side wall, said bottom wall and cylindrical side wall define an inner receiving area for receiving said routing subassembly; and said base member includes a plurality of slots for receiving said plurality of contact members, respectively.

11. A multiposition switch according to claim 1, further comprising a combiner coupled to at least first and second contacts of said plurality of contacts.

12. A multiposition switch according to claim 1, further comprising indicia provided on said base member identifying the combined and uncombined positions, respectively.

13. A multiposition switch according to claim 12, wherein said actuator includes a knob with indicia for identifying at least one of the combined and uncombined positions.

14. A multiposition switch, comprising:

a base member accommodating a plurality radially spaced contact members said plurality of contact members adapted to electrically mate to a host printed circuit board; and a routing subassembly rotatably coupled to said base member, said routing subassembly including a routing disc that defines a plurality of electrical paths between said plurality of contact members for switching between combined and uncombined positions, said routing disc including a plurality of stacked printed circuit boards electrically coupled to one another, and an actuator coupled to said routing disc for rotating said routing disc with respect to said base member between said combined and uncombined positions, wherein in said combined position, a first contact member of said plurality of contact members is electrically coupled to a second contact member of said plurality of contact members via said electrical paths of said routing disc, and a third contact member of said plurality of contact members is electrically coupled to a fourth contact member of said plurality of contact members via said electrical paths of said routing disc, and wherein in said uncombined position, said first contact member is electrical connected to said third contact member via said electrical paths of said routing disc, and said second contact member is electrically connected to said fourth contact member.

15. A multiposition switch according to claim 14, further comprising a combiner coupled to said second and fourth contact members.

16. A multiposition switch according to claim 14, wherein in said combined position, a fifth contact member of said plurality of contact members is electrically coupled to a sixth contact member of said plurality of contact members via said electrical paths of said routing disc, and a seventh contact member of said plurality of contact members is electrically coupled to an eighth contact member of said plurality of contact members via said electrical paths of said routing disc, and in said uncombined position, said fifth contact member is electrical connected to said eighth contact member via said electrical paths of said routing disc, and said sixth contact member is electrically connected to said seventh contact member.

17. A multiposition switch according to claim 14, wherein a combiner is coupled to said second, fourth and fifth contact members.

18. A multiposition switch according to claim 14, wherein each of said printed circuit boards of said routing disc has signal routing paths, and said signal routing paths are configured to route signals over top of each other.

19. A multiposition switch according to claim 14, wherein one of said routing disc and said actuator includes at least one tab for engaging said base member, said tab limiting the rotational movement of said routing disc with respect to said base member between the combined and uncombined positions.

20. A multiposition switch according to claim 18, wherein said base member includes a bottom wall; and said bottom wall of said base member includes at least one raised rib for engaging said tab, said raised rib of said bottom wall includes first and second opposite ramps that engage said tab when rotating said routing member with respect to said base member.

21. A multiposition switch according to claim 14, wherein said plurality of contact members are spaced about a bottom wall of said base member, and each of said contact members has opposite first and second ends, said first ends are configured to couple to the host printed circuit board and the second ends are configured to couple to the routing disc.

22. A multiposition switch according to claim 20, further comprising each of said plurality of contact members includes an intermediate portion between said first and second ends; and an insulator surrounds said intermediate portion of each of said contact members.

23. A multiposition switch according to claim 14, wherein said routing subassembly includes a fastener, said fastener has a rib that is configured to mate with a groove of said base member, thereby providing fine positioning control between said routing disc and said plurality of contacts.

* * * * *